US006540418B1

(12) United States Patent
Sato

(10) Patent No.: US 6,540,418 B1
(45) **Date of Patent: *Apr. 1, 2003**

(54) RECORDING APPARATUS

(75) Inventor: Kaoru Sato, Minami Ashigara (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/985,739

(22) Filed: Dec. 5, 1997

(30) Foreign Application Priority Data

Dec. 19, 1996 (JP) ..... 8-339777

(51) Int. Cl.[7] ..... B41J 11/46

(52) U.S. Cl. ..... 400/582; 400/76; 400/70; 400/61; 400/578

(58) Field of Search ..... 400/582, 578, 400/76, 70, 61

(56) References Cited

U.S. PATENT DOCUMENTS 4,903,956 A * 2/1990 Stephens et al. ..... 271/178
5,018,081 A * 5/1991 Yamaguchi et al. ..... 400/76
5,696,690 A * 12/1997 Richardson et al. ..... 271/3.01
5,748,483 A * 5/1998 Richardson et al. ..... 700/223
5,870,114 A * 2/1999 Numata et al. ..... 347/16
6,182,964 B1 * 2/2001 Tanaka et al. ..... 271/199

FOREIGN PATENT DOCUMENTS

JP 11035226 A * 2/1999

* cited by examiner

*Primary Examiner*—Andrew H. Hirshfeld
*Assistant Examiner*—Charles H. Nolan, Jr.
(74) *Attorney, Agent, or Firm*—Fitzpatrick, Cella, Harper & Scinto

(57) ABSTRACT

Sheet ejecting apparatuses, which are connected to a recording apparatus, are selectively operated during the operation of the printer. When a sheet transported in a recording unit reaches a paper ejecting sensor, the recording unit outputs a predetermined signal to an image control unit. When the predetermined signal is inputted, the image control unit outputs a sheet ejection notice command of the sheet to a sheet ejecting apparatus, which is selected by the operator. The sheet ejecting apparatus to which the paper ejection notice command is inputted starts a drive motor and the like to eject the recording paper.

19 Claims, 9 Drawing Sheets

RECORDING APPARATUS

BACKGROUND OR THE INVENTION

1. Field of the Invention

The present invention relates to a recording apparatus to which a paper ejecting apparatus is connected.

2. Related Background Art

In the recording apparatus such as printer, there is known a configuration where a paper ejecting apparatus such as a sorter is connected to the recording apparatus. In recent years, there has been proposed a configuration where a plurality of paper ejecting apparatuses are connectable to a recording apparatus. With the conventional control method, in case that a plurality of paper ejecting apparatuses are connected to the recording apparatus, all the paper ejecting apparatuses are driven during the operation of the recording apparatus.

However, the operation of all the paper ejecting apparatuses during the operation of the recording unit increases power consumption and it is not desirable in consideration of electric cost and electric capacity of the total recording system. Further, there is a problem of noise since all the paper ejecting apparatuses are simultaneously operated.

SUMMARY OF THE INVENTION

It is therefore an object of the present invention to provide a recording apparatus in which the above-mentioned problems are solved.

Another object of the present invention is to reduce power consumption and noise by avoiding a situation where the paper ejecting apparatuses connected to the recording apparatus are operated even when the paper ejecting apparatuses need not be operated.

Still another object of the present invention is to provide a recording apparatus to which a variety of paper ejecting apparatuses are connectable. Furthermore, with the present invention, even when a plurality of paper ejecting apparatuses are connected to the recording apparatus, the paper ejecting apparatuses are selectively operated.

The present invention provides a recording apparatus comprising: first control means for controlling the recording apparatus including a recording unit for recording an image on a sheet; and second control means for directly controlling the recording unit while communicating with the first control means, wherein the first control means outputs a signal for starting the ejecting operation to an ejecting apparatus for ejecting a sheet which is ejected from the recording unit, in accordance with a signal indicating the state of a recording operation and inputted from the second control means.

Further, the present invention provides a recording control apparatus for controlling the recording apparatus for recording an image on a sheet comprising: first output means for outputting a signal for starting a recording operation to the recording apparatus; input means for inputting a signal indicating the a state of a transporting operation of a sheet from the recording unit; and second output means for outputting a signal for starting an ejecting operation to an ejecting device, which is connected to the recording apparatus, in accordance with the signal inputted from the inputting means.

Furthermore, the present invention provides a paper ejecting apparatus connected to a recording apparatus for recording an image on a sheet, the paper ejecting apparatus comprising: transporting means for transporting the sheet to a sheet ejecting device; input means for inputting a signal in accordance with the state of the transporting operation of the recording apparatus from the recording control device for controlling the recording apparatus; and control means for starting the operation of the transporting means in accordance with the signal inputted from the input means.

Further, the present invention provides a recording apparatus for recording an image on a sheet comprising: transporting means for transporting the sheet to record the image on the sheet and to eject the sheet; detection means for detecting that the sheet is transported to a predetermined position; and outputting means for outputting a predetermined signal to a recording apparatus control device for controlling the recording apparatus in accordance with a detecting result of the detecting means.

Furthermore, the present invention provides a control device for controlling a recording unit for recording an image on a sheet and for ejecting the sheet through one of plural ejecting routes, the control device comprising: input means for inputting information indicating to which one of the plural ejecting routes the sheet is ejected; detection means for detecting the state of transportation of the sheet at the recording unit; and outputting means for outputting a signal for starting the ejecting operation to an ejecting device which is connected to the ejecting route indicated by the information which is inputted from the input means in accordance with a detecting result of the detecting means.

Other objects and features of the present invention will be apparent from the following description of the preferred embodiment which is to be taken with reference to the accompanying drawings.

DETAILED DESCRIPTION OF THE PREFERRED EMBODIMENTS (First Embodiment)

Figure 4:
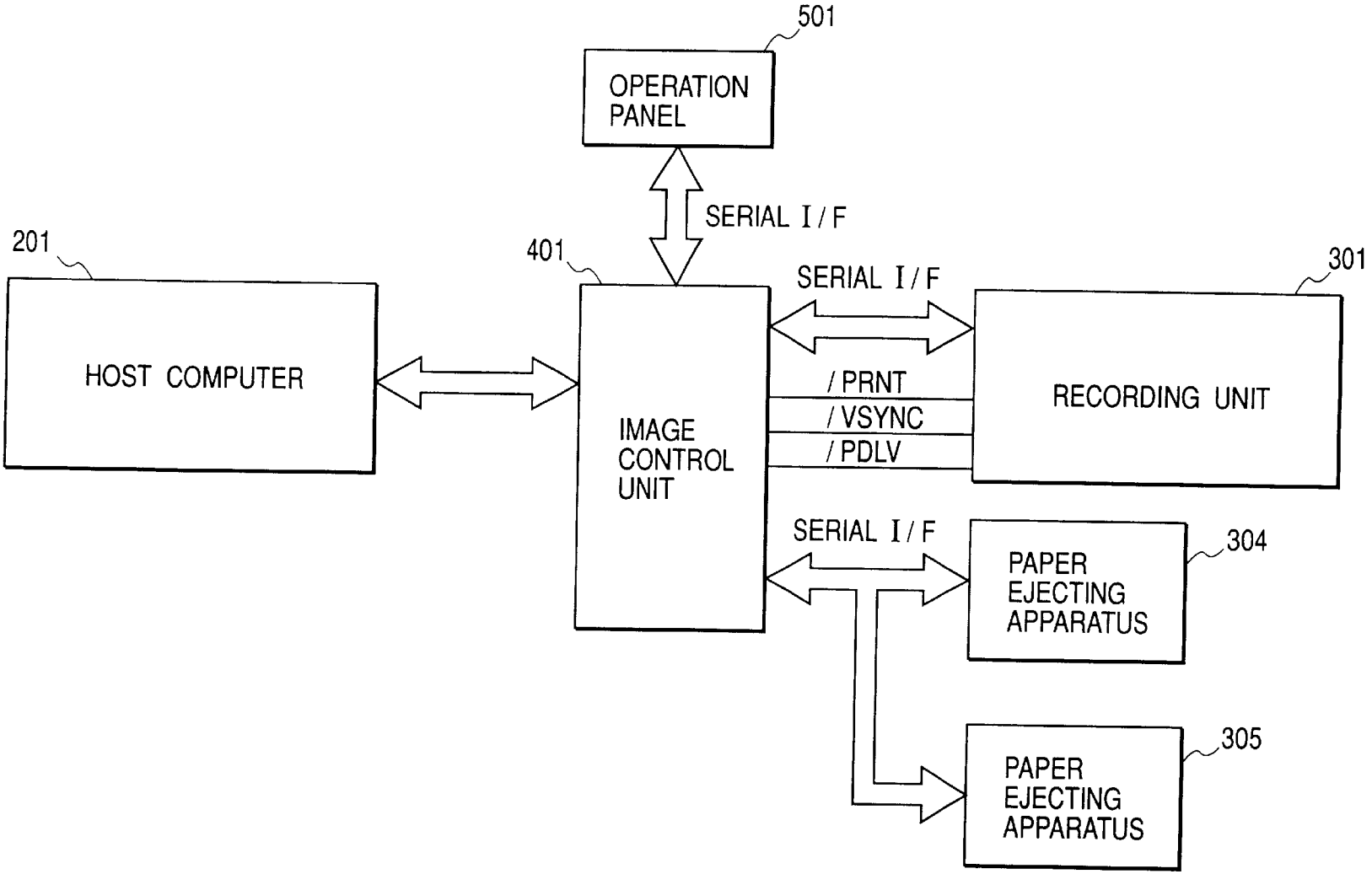
FIG. 4 is a block diagram of the printer shown in FIG. 4.

FIG. 4 is a block diagram of a printer according to an embodiment of the present invention. Numeral 401 indicates an image control unit including a microcomputer, a ROM, and a RAM, and receiving a print command and image data from a host computer 201. Reference numeral 301 indicates a recording unit provided with a microcomputer with incorporated ROM and RAM, and controlled by the image control unit 401 through a serial communication line and control signals. The recording unit 301 receives image data, developed in a raster image, from the image control unit, and the image is recorded on a recording sheet through an electrophotographic process. Reference numerals 304 and 305 are paper ejecting apparatuses which are connected to the recording unit 301 respectively, and each of the paper ejecting apparatuses includes a microcomputer with incorporated ROM and RAM, and is controlled by the image control unit 401 through serial communication. Numeral 501 is an operation panel of the printer.

Figure 3:
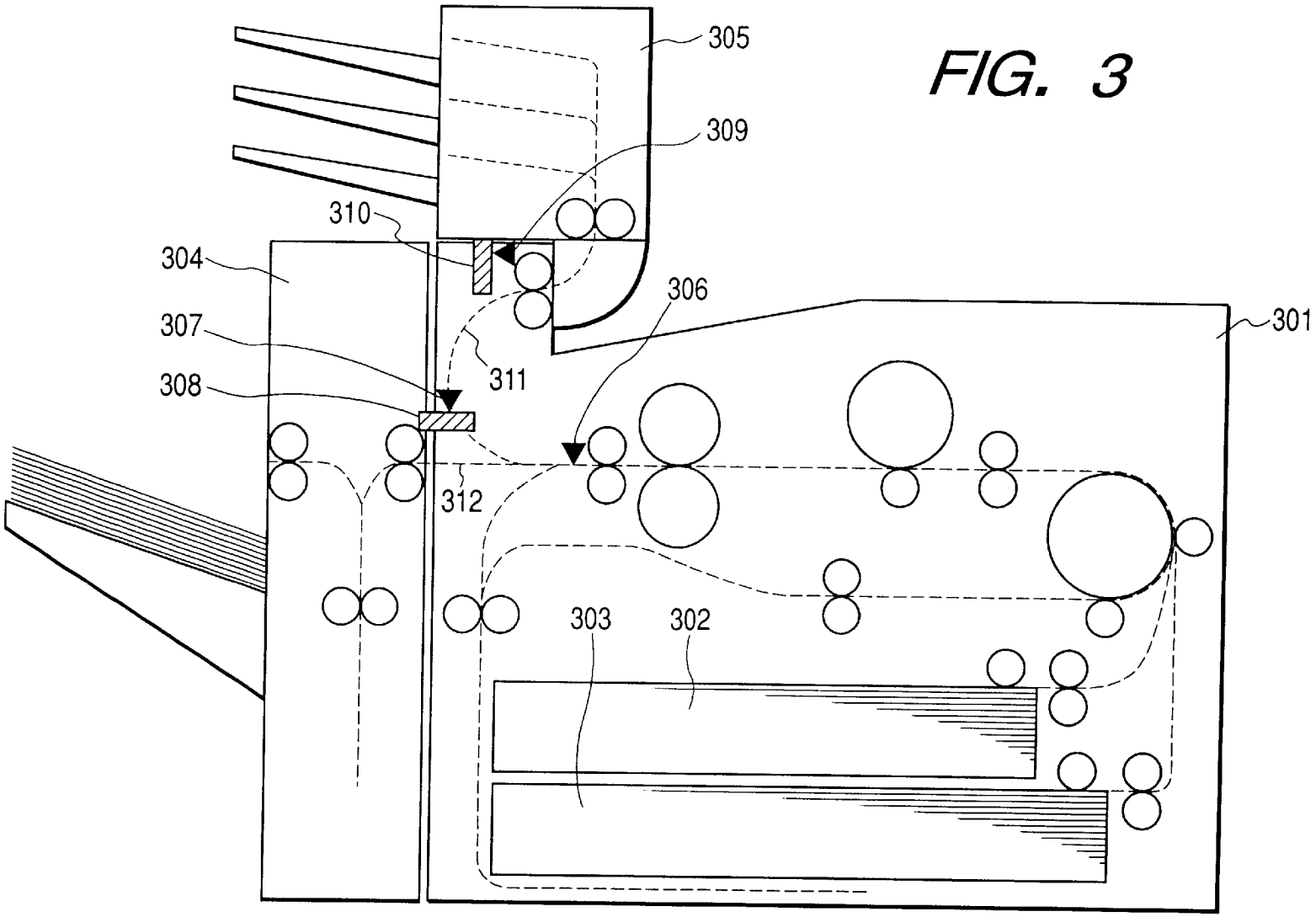
FIG. 3 is a schematic cross-sectional view of a printer and a paper ejecting apparatus according to the present invention.

As illustrated in FIG. 3, the paper ejecting apparatus 304 is connected to a face-up paper ejecting route 312 of the recording unit 301, and when a connection sensor 307, of which detecting signal is inputted to the microcomputer of the recording unit 301, detects a connection joint 308, the connected state is recognized. The paper ejecting apparatus 305 is connected to a face-down paper ejecting route 311 of the recording unit 301, and when a connection sensor 309, of which detecting signal is inputted to the microcomputer of the recording unit 301, detects a connection joint 310, the connected state is recognized. Reference numeral 302 shows an upper stage paper feeding cassette, and 303 a lower stage paper feeding cassette, 306 a paper ejecting sensor.

Figure 1:
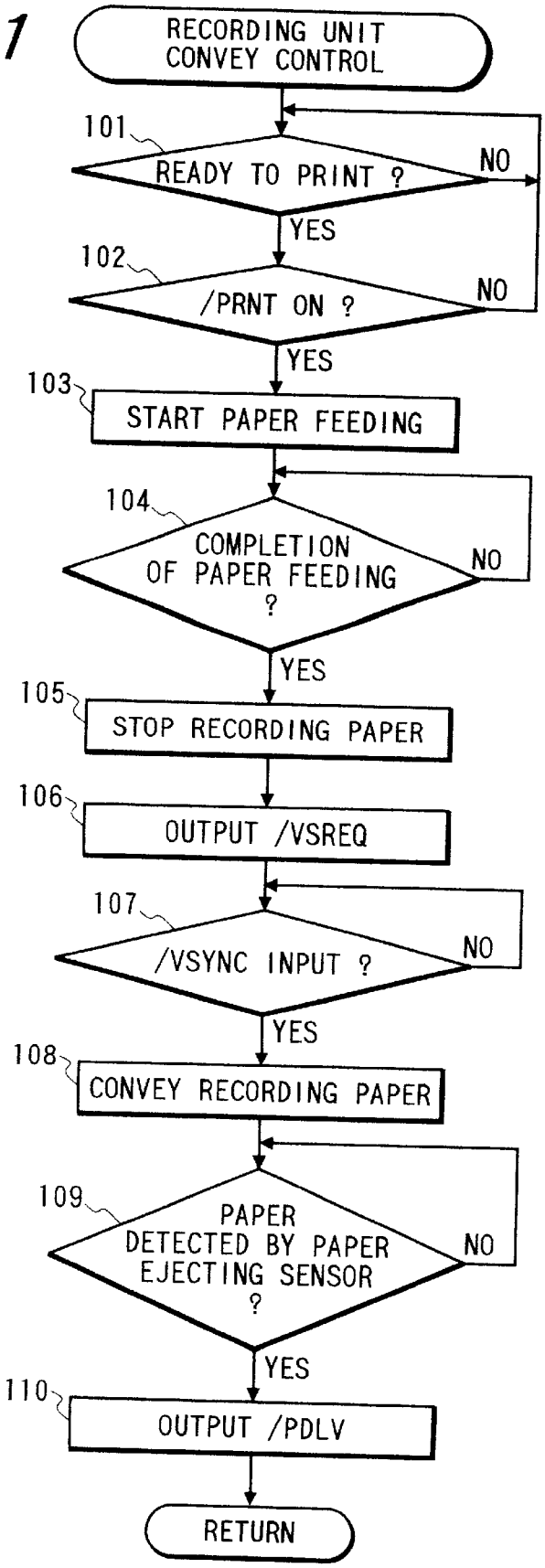
FIG. 1 is a flowchart of a recording apparatus according to the present invention.

FIG. 1 is a flowchart of the recording sheet transportation control in the recording unit 301 when the printer is operated. At S101, the process waits until the printer becomes operable while checking whether or not a recording paper is stacked in the paper feeding unit which is already designated and whether or not a toner cartridge is mounted. If the printer is operable, the process waits in S102 until a print signal (hereinafter merely referred to as "/PRNT signal") from the image control unit 401 becomes ON. If the /PRNT signal is ON, at S103, paper feeding is started, and the process waits until the paper feeding is completed at S104. If the paper feeding is completed, the transportation of the recording paper is stopped at S105. At S106, in order to synchronize the transportation of the recording paper and the image formation, an image synchronization signal requesting signal (hereinafter merely referred to as "/VSREQ signal") is outputted to the image control unit 401. At S107, the process waits until an image synchronization signal (hereinafter merely referred to as "/VSYNC signal") is inputted from the image control unit 401. When the /VSYNC signal is inputted, the transportation of the recording paper is started again at S108, and the process waits until the paper ejecting sensor 306 detects the recording paper at S109. The image recording operation is carried out in parallel the the transportation of the recording paper at S108. At the point that the paper ejecting sensor 306 detects the recording paper bearing the recorded imaged, a paper ejecting signal (hereinafter merely referred to as "/PDLV signal") is outputted at S110 to the image control unit 401.

Figures 2, 2A:
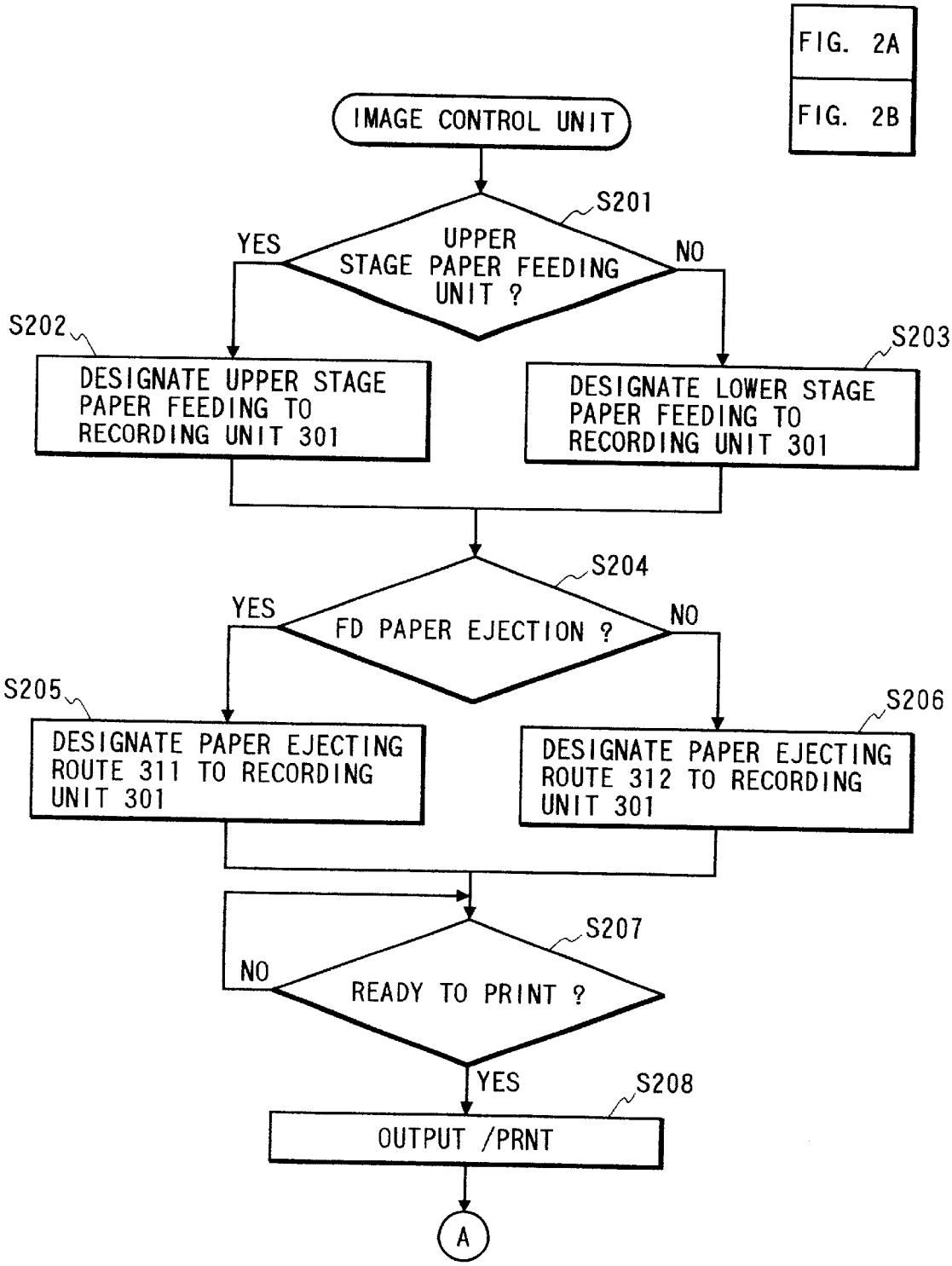
FIG. 2 comprised of FIGS. 2A and 2B, is a flowchart of an image control unit according to the present invention.
Figure 2B:
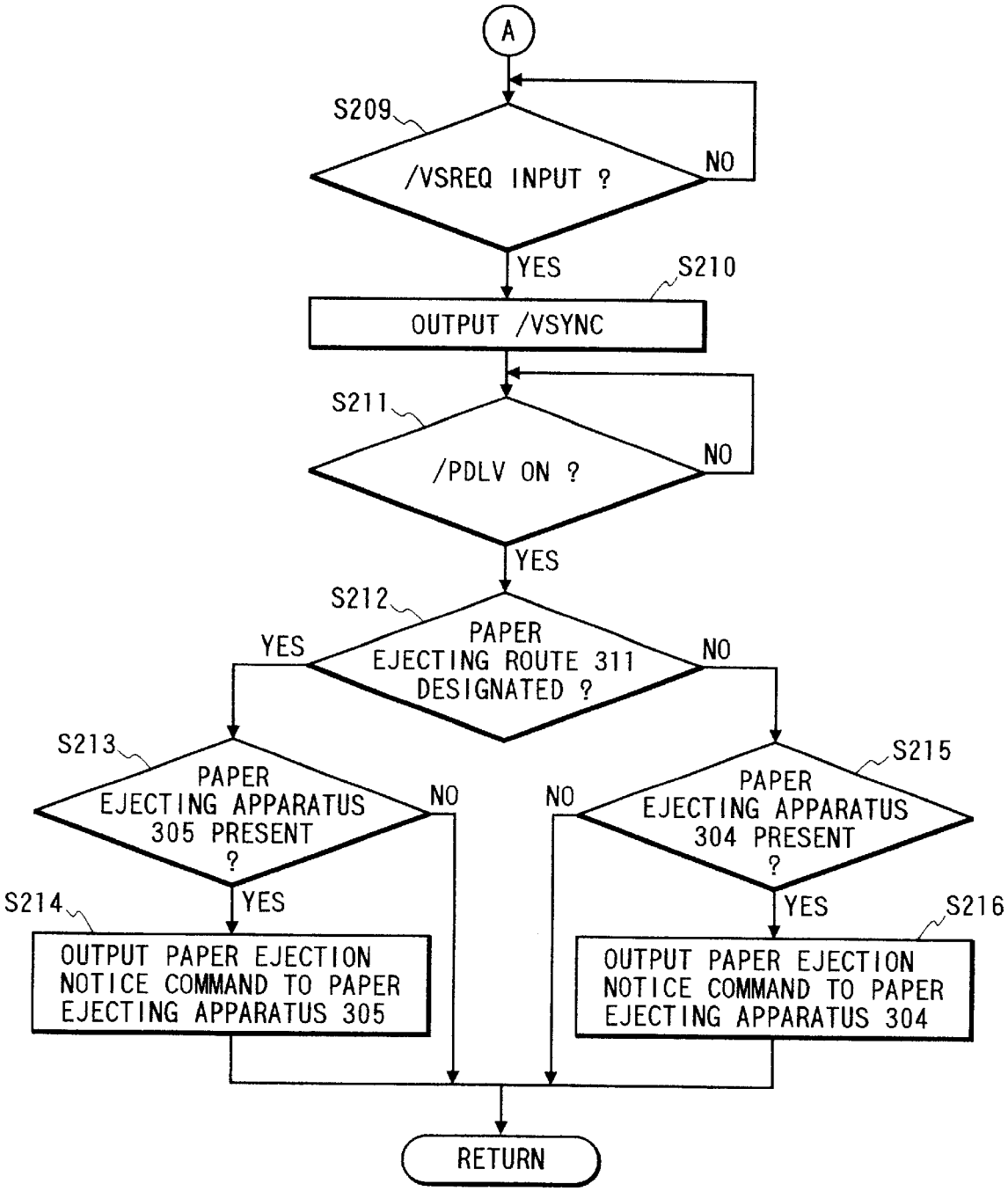

FIGS. 2A and 2B are flowcharts of the printing Coperation control in the image control unit 401. At S201, a paper feeding unit designated by the host computer 201 is judged. If the upper stage paper feeding unit is designated, the upper stage paper feeding unit is designated to the recording unit 301 at S202. If the lower stage paper feeding unit is designated, the lower stage paper feeding unit is designated to the recording unit 301 at S203. At S204, a paper ejecting apparatus designated by the host computer 201 is judged. If the paper ejecting apparatus 305 is designated, at S205, the process instructs the recording unit 301 to eject paper to the paper ejecting apparatus 305, that is, to eject paper to the face-down paper ejecting route 311. If the paper ejecting apparatus 304 is designated, at S206, the process instructs the recording unit 301 to eject paper to the paper ejecting apparatus 304, that is, to eject paper to the face-down paper ejecting route 312. At S207, a status outputted from the recording unit 301 is judged, and the process waits until it becomes printable. If it becomes printable, at S208, /PRNT signal is outputted to the recording unit 301. At S209, the process waits until the /VSREQ signal from the recording unit 301 becomes ON. If the /VSREQ signal becomes ON, at S210, /VSYNC signal is outputted to the recording unit 301, and simultaneously image data is outputted to the recording unit 301.

If the /PDLV signal outputted from the recording unit 301 becomes ON at S211, the paper ejecting apparatus designated to the recording unit 301 is checked at S212. If the paper ejecting apparatus 305 is designated, a signal indicating that the paper ejecting apparatus 305 is connected is inputted at S213 from the recording unit 301 to judge whether or not the paper ejecting apparatus 305 is connected, and if connected, a paper ejection notice command is outputted at S214 to the paper ejecting apparatus 305. Input of the paper ejection notice command causes the paper ejecting apparatus 305 to judge that a recording paper is to be fed in a prescribed period of time, and to perform the preparation for the feeding of recording paper, that is, starting of a transporting motor. At S212, if the paper ejecting apparatus 304 is designated, a signal indicating that the paper ejecting apparatus 304 is connected is inputted at S215 from the recording unit 301 to judge whether or not the paper ejecting apparatus 304 is connected, and if connected, a paper ejection notice command is outputted at S216 to the paper ejecting apparatus 304. Input of the paper ejection notice command causes the paper ejecting apparatus 304 to judge that a recording paper is to be fed after a prescribed period of time passes, and to perform the preparation for the feeding of the recording paper, that is, starting of a transporting motor.

In the present embodiment, the recording paper ejected from the face-down paper ejecting route 311 is ejected in a face-down state when the paper ejecting apparatus 305 is not connected, and is ejected in a face-up state when the paper ejecting apparatus 305 is connected. Further, the recording paper ejected from the face-up paper ejecting route 312 is ejected in a face-up state when the paper ejecting apparatus 304 is not connected, and is ejected in a face-down state when the paper ejecting apparatus 304 is connected.

(Second Embodiment)

In the second embodiment of the present invention, the recording unit 301 is set from the panel 501 which is connected to the image control unit 401. In the first embodiment, the connection is confirmed by the sensors 309, 307 for confirming the connection of the paper ejecting apparatus, situated in the vicinity of the face-down paper ejecting route 311 and the face-up paper ejecting route 312 of the recording unit 301, but in the second embodiment, these sensors are not disposed, but in place of the sensors, when the operator connects the paper ejecting apparatus to the recording unit, the operator sets the connection of the paper ejecting routes between the paper ejecting apparatus and the recording unit 301 from the operation panel 501. Then, based on the settings, only when the paper ejecting apparatus is connected to the designated paper ejecting route, the /PDLV signal is outputted from the recording unit 301 to the image control unit 401, and when the /PDLV signal is inputted, the image control unit 401 outputs the paper ejection notice command to the paper ejecting apparatus, and when /PDLV signal is not inputted after a prescribed period of time passes, it is judged that the paper ejecting apparatus is not connected, so that the process awaits the next command.

(Third Embodiment)

Figure 5:
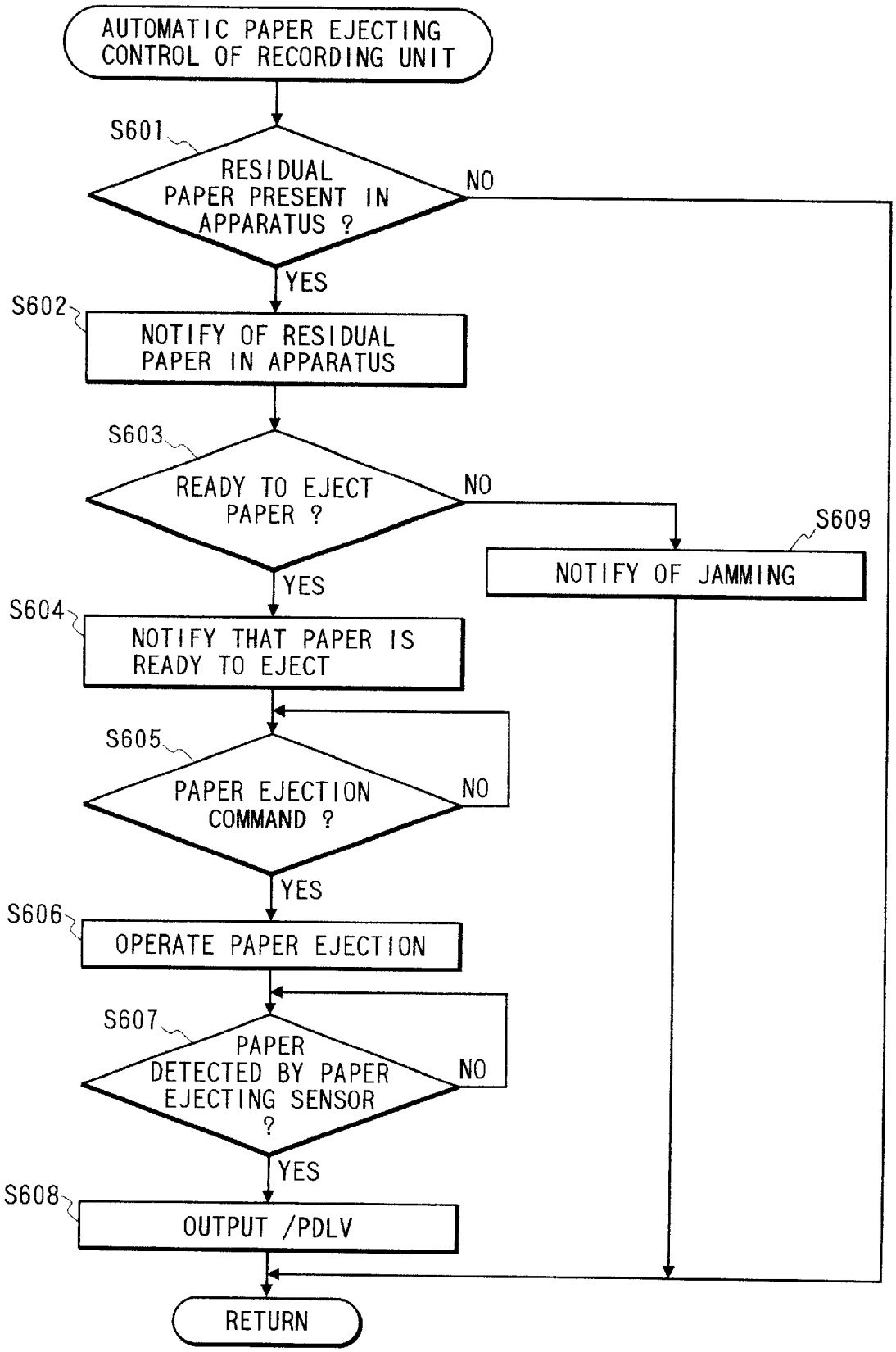
FIG. 5 is a flowchart of a recording apparatus according to the present invention.
Figure 6:
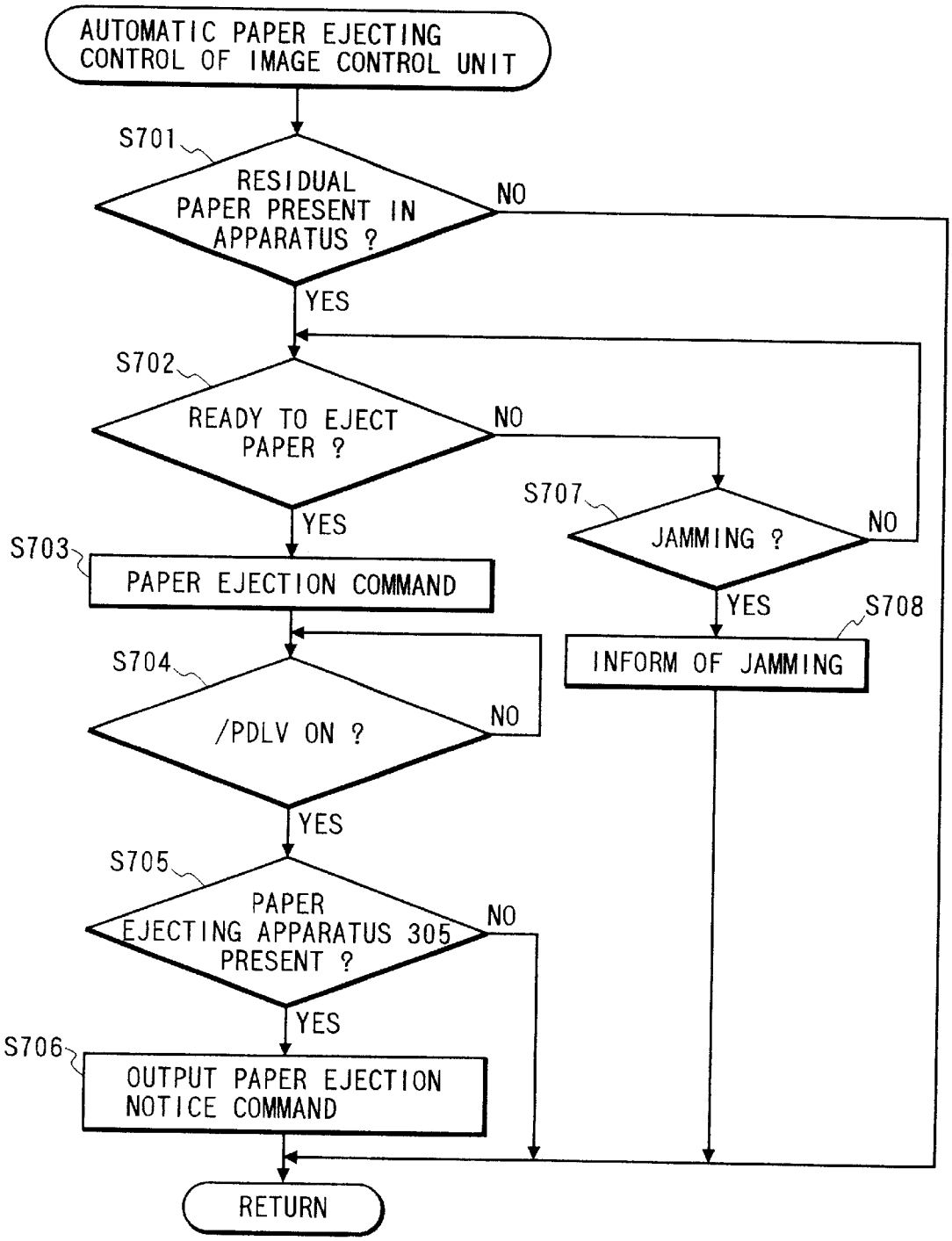
FIG. 6 is a flowchart of an image control unit according to the present invention.

FIGS. 5 and 6 are flowcharts showing the third embodiment of the present invention. This embodiment relates to control at the ejection of the remaining recording paper in the recording unit 301. FIG. 5 is a flowchart of automatic paper ejection control of the recording unit 301. At S601, it is judged whether or not the recording paper remains on the transporting route in the recording unit 301, and if the recording paper remains, the fact that the recording paper remains in the device is notified in S602 to the image control unit 401 through serial communication. At S603, it is judged whether or not the recording paper is ejectable for example from the position of the recording paper, and if the recording paper is not ejectable, the condition of jamming is notified at S609 to the image control unit 401. If the recording paper is ejectable, the fact that the remaining recording paper is ejectable is notified at S604 to the image control unit 401. At S605, the process waits until the automatic ejection command is transmitted from the image control unit 401. When the automatic ejection command is received, the remaining recording paper is ejected at S606. At the ejection of the remaining recording paper, the recording paper is automatically ejected from the face-down paper ejecting route 311 which is connected to the image control unit 401. At S607, the process waits until the paper ejecting sensor 306 detects the recording paper, and when the paper ejection sensor detects the recording paper, /PDLV signal is outputted at S608 to the image control unit 401.

FIG. 6 is a flowchart of control in the image control unit 401 at the automatic paper ejection process. At S701, it is judged whether a notice that the recording paper remains in the device is received from the recording unit 301, and at S702, a notice from the recording unit 301 is checked to judge whether or not it is ejectable. If it is not ejectable, it is judged at S707 whether or not a jamming occurs, and if a jamming occurs, a signal indicating the occurrence of jamming is outputted to the operation panel 501 and the host computer to notify the fact to the operator. If a jamming does not occur, it is checked again at S702 whether or not it is ejectable. If it is ejectable, the automatic paper ejection command is outputted at S703 to the recording unit 301. At S704, the process waits until the /PDLV signal from the recording unit 301 becomes ON, and if the signal becomes ON, it is judged at S705 whether or not the paper ejecting apparatus 305 is connected to the face-down paper ejecting route 311 of the recording unit 301, and if the connection is confirmed, the paper ejection notice command is outputted at S706 to the paper ejecting apparatus 305.

(Fourth Embodiment)

Figure 8:
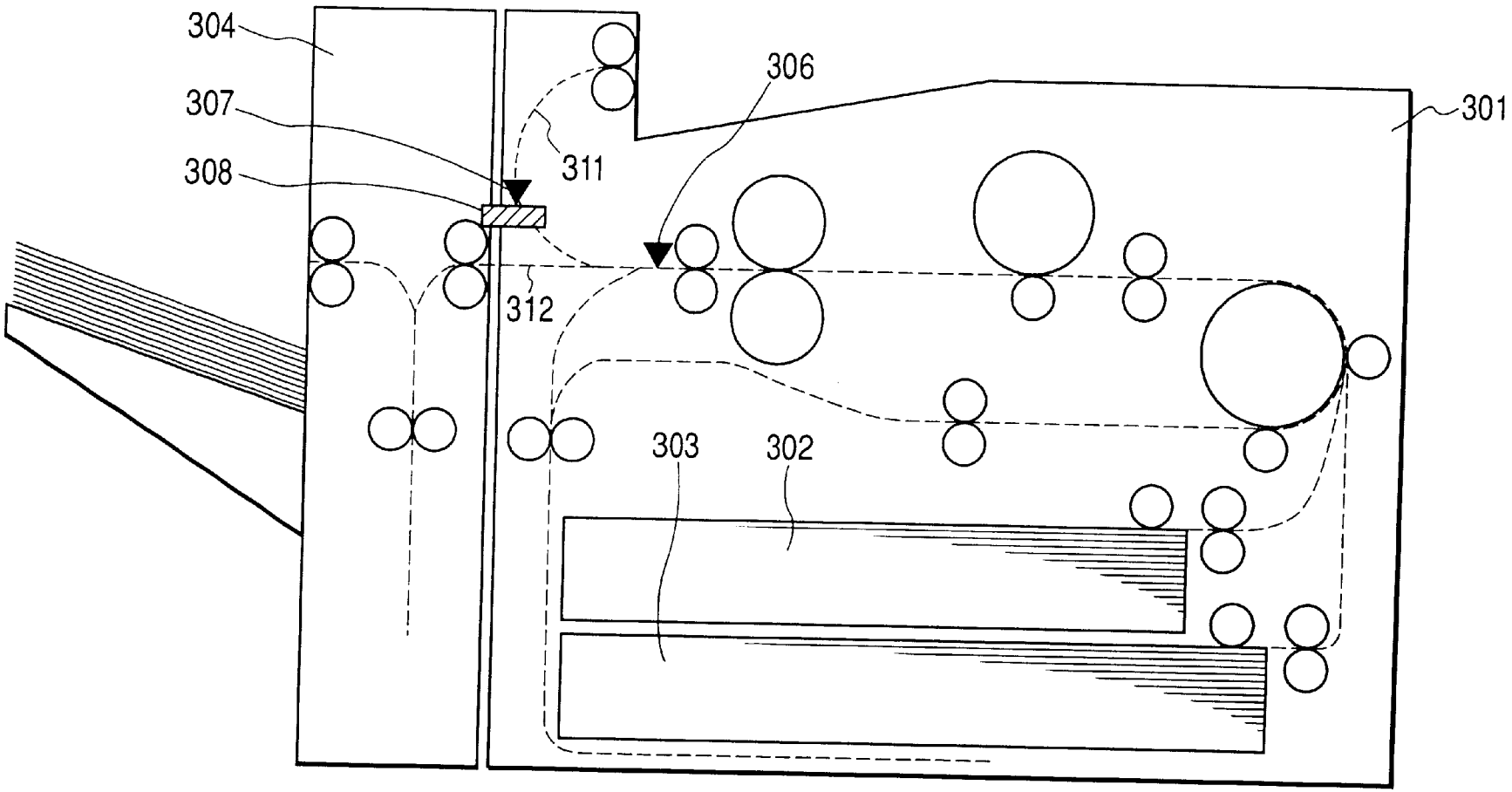
FIG. 8 is a schematic cross-sectional view of a printer and a paper ejecting apparatus according to the present invention.

FIG. 8 shows the configuration of the fourth embodiment of the present invention. In this embodiment, a paper ejecting apparatus is not mounted to the face-down paper ejecting route 311. The face-down paper ejecting apparatus route 311 in the present embodiment is used for a special printing job or used as a paper ejecting section for defective recording paper which is generated at an erroneous operation.

Figure 7:
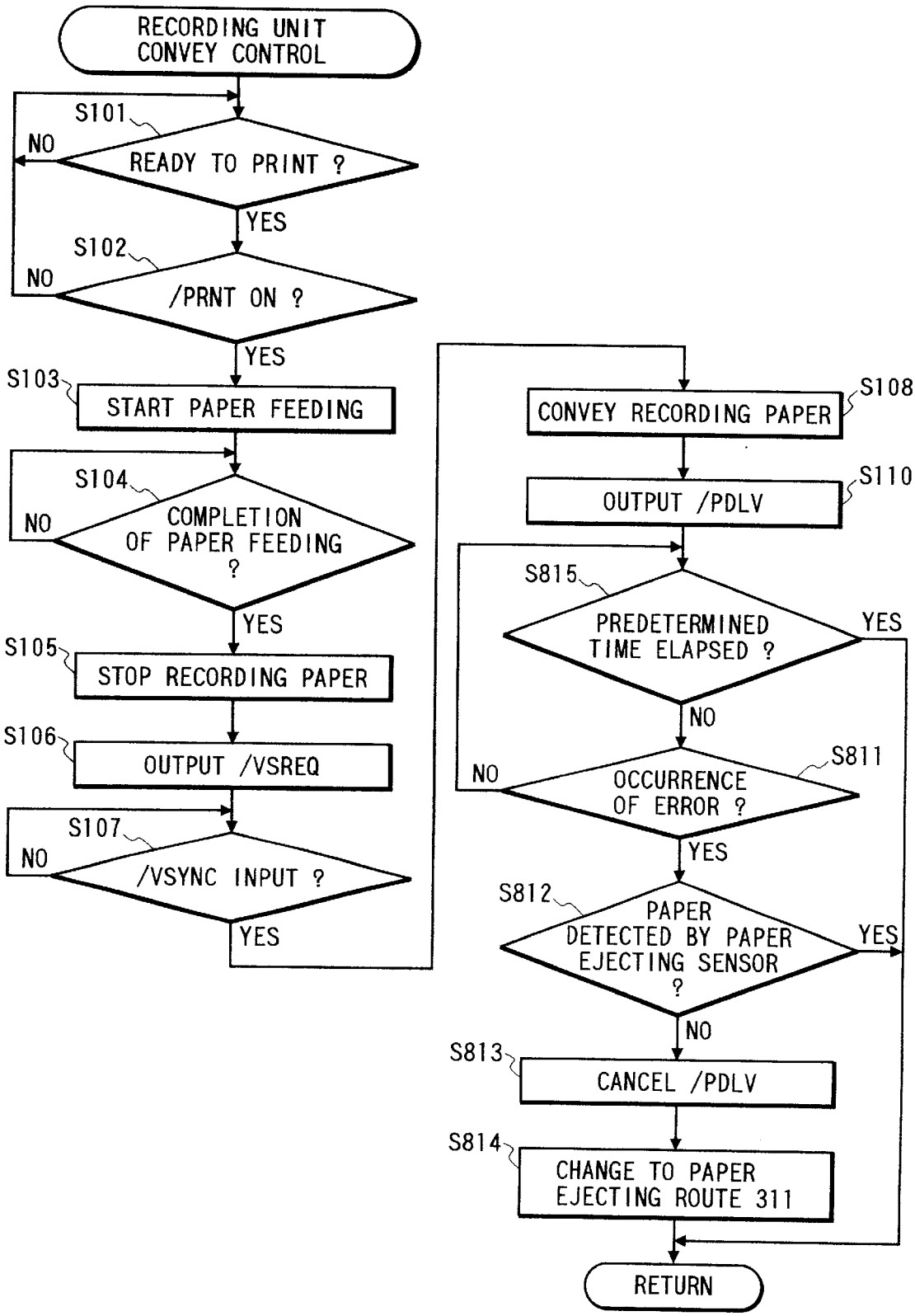
FIG. 7 is a flowchart of a recording apparatus according to the present invention.

FIG. 7 is a flowchart of control in the recording unit 301. The steps from S101 to S108 are the same as those shown in FIG. 1, so that the explanation therefor will be omitted. At S108, after the transportation of recording paper is restarted, in this embodiment, the /PDLV signal is instantly outputted at S110 to the image control unit 401. Even after the image control unit 401 receives the signal, the paper ejection notice command is not outputted to the paper ejecting apparatus for a predetermined period time. This predetermined period time is the time from the outputting of the /VSYNC signal by the image control unit 401 to the detection of the recording paper by the paper ejecting sensor 306, and corresponds to the time set between the image control unit 401 and the recording unit 301 in advance. At S110, the /PDLV signal is outputted, and at S811, it is checked whether or not an error is generated. This error is for example the shift of the image data transmission synchronization signal in a main scanning direction, and is of a sort which has no effect on the transportation of recording paper but generates a defective image. If an error is generated, it is judged at S812 whether or not the paper ejecting sensor 306 detects the recording paper, and if the paper ejecting sensor 306 does not detect the recording paper, the cancellation of the /PDLV signal is outputted at S813 to the image control unit 401, and at S814, the destination of the recording paper is changed to the face-down paper ejecting route 311. The image control unit 401 monitors the notice for a predetermined period of time after receiving the ON state of the /PDLV signal, so that upon receiving the /PDLV signal cancellation notice, the image control unit 401 does not output the paper ejection notice command to the paper ejecting apparatus 304 which is connected to the face-up paper ejecting route 312 of the recording unit 301. In case that the image control unit 401 does not receive the cancellation for a predetermined period of time, the image control unit 401 outputs the paper ejection notice command to the paper ejecting apparatus 304. If no error is generated for a predetermined period of time at the judgment at S811, the step goes out of the loop at S815.

What is claimed is:

1. A control apparatus, including a first microcomputer, which controls an image recording apparatus forming an image on a sheet and controls a sheet stacking apparatus, including a stacking unit, to stack sheets thereon ejected from said image recording apparatus, said control apparatus comprising:

receiving means for receiving a print command and image data from an external apparatus;

recording control means for controlling said image recording apparatus to record the image on the sheet in accordance with the print command and image data received by said receiving means;

input means for inputting a signal indicating a state of sheet transportation in said image recording apparatus from said image recording apparatus, said image recording apparatus including a second microcomputer; and output means for outputting a notice command for starting an operation of said sheet stacking apparatus to said sheet stacking apparatus, said sheet stacking apparatus including a third microcomputer, in accordance with the signal input by said input means.

2. A control apparatus according to claim 1, further comprising a sensor, wherein the signal is generated if said sensor detects a sheet transported in said image recording apparatus.

3. A control apparatus according to claim 2, wherein said sensor is an ejecting sensor.

4. A control apparatus according to claim 1, wherein said control apparatus controls a plurality of sheet stacking apparatuses, said control apparatus further comprising:

transport control means for controlling said image recording apparatus to transport the sheet to a designated one of said plurality of sheet stacking apparatuses, wherein said output means outputs the notice command to said designated one of said plurality of sheet stacking apparatuses.

5. A control apparatus according to claim 4, wherein said transport control means controls said image recording apparatus to transport the sheet to said designated one of said plurality of sheet stacking apparatuses designated by said external apparatus.

6. A control apparatus according to claim 5, further comprising:

checking means for checking whether said designated one of said plurality of sheet stacking apparatuses is connected to said image recording apparatus, wherein said output means outputs the notice command to said designated one of said plurality of sheet stacking apparatuses in a case where said designated one of said plurality of sheet stacking apparatuses is connected to said image recording apparatus.

7. A control apparatus according to claim 1, wherein said input means inputs the signal through a first interface and said output means outputs the notice command through a second interface.

8. A control apparatus, including a first microcomputer, which controls an image recording apparatus forming an image on a sheet and controls a plurality of sheet stacking apparatuses, each including a stacking unit to stack sheets thereon ejected from said image recording apparatus, said control apparatus comprising:

transport controlling means for controlling said image recording apparatus, said image recording apparatus including a second microcomputer, to transport the sheet to a designated one of said plurality of sheet stacking apparatuses, said designated one of said plurality of sheet stacking apparatuses including a third microcomputer; and output means for outputting a notice command for starting an operation of a sheet stacking apparatus to said designated one of said plurality of sheet stacking apparatuses.

9. A control apparatus according to claim 8, further comprising:

receiving means for receiving a print command and image data from an external apparatus; and recording control means for controlling said image recording apparatus to record an image on a sheet in accordance with the print command and image data received by said receiving means, wherein said transport control means controls said image recording apparatus to transport the sheet to said designated one of said plurality of sheet stacking apparatus designated by the external apparatus.

10. A control method of a control apparatus, including a first microcomputer, which controls an image recording apparatus forming an image on a sheet and controls a sheet stacking apparatus, including a stacking unit, to stack sheets thereon ejected from said image recording apparatus, said control method comprising the steps of:

receiving a print command and image data from an external apparatus;

controlling the image recording apparatus to record the image on the sheet in accordance with the print command and image data received by said receiving step;

inputting a signal indicating a state of sheet transportation in the image recording apparatus from the image recording apparatus, the image recording apparatus including a second microcomputer; and outputting a notice command for starting an operation of the sheet stacking apparatus to the sheet stacking apparatus, the sheet stacking apparatus including a third microcomputer, in accordance with the signal input by said inputting step.

11. A control method according to claim 10, further comprising a step of sensing if the sheet is being transported in the image recording apparatus, wherein the signal is generated if said sensing step detects that the sheet is being transported in the image recording apparatus.

12. A control method according to claim 11, wherein said sensing step is performed by an ejecting sensor provided in the image recording apparatus.

13. A control method according to claim 10, wherein said control method controls a plurality of sheet stacking apparatuses, said control method further comprising the steps of:

transport controlling the image recording apparatus by a transport control means to transport the sheet to a designated one of the plurality of sheet stacking apparatuses, wherein said outputting step outputs the notice command to the designated one of the plurality of sheet stacking apparatuses.

14. A control method according to claim 13, wherein said transport controlling step controls the image recording apparatus to transport the sheet to the designated one of the plurality of sheet stacking apparatuses designated by the external apparatus.

15. A control method according to claim 14, further comprising the step of:

checking whether the designated one of the plurality of sheet stacking apparatuses is connected to the image recording apparatus, wherein said outputting step outputs the notice command to the designated one of the plurality of the sheet stacking apparatuses if the designated one of the plurality of sheet stacking apparatuses is connected to the image recording apparatus.

16. A control method according to claim 10, wherein said inputting step inputs the signal through a first interface and said outputting step outputs the notice command through a second interface.

17. A control method of a control apparatus, including a first microcomputer, which controls an image recording apparatus forming an image on a sheet and controls a plurality of sheet stacking apparatuses each, including a stacking unit, to stack sheets thereon ejected from the image recording apparatus, said control method comprising the steps of:

transport controlling the image recording apparatus, the image recording apparatus including a second microcomputer, to transport the sheet to a designated one of the plurality of sheet stacking apparatuses, the designated one of the plurality of sheet stacking apparatuses including a third microcomputer; and outputting a notice command for starting an operation of a sheet stacking apparatus to the designated one of the plurality of sheet stacking apparatuses.

18. A control method according to claim 8, further comprising the steps of:

receiving a print command and image data from an external apparatus; and recording controlling the image recording apparatus to record an image on a sheet in accordance with the print command and image data received in said receiving step, wherein said transport controlling step controls the image recording apparatus to transport the sheet to the designated one of the plurality of sheet stacking apparatuses designated by the external apparatus.

19. A control apparatus, including a first microcomputer, which controls an image recording apparatus forming an image on a sheet and controls a sheet stacking apparatus, including a stacking unit, to stack sheets thereon ejected from said image recording apparatus, said control apparatus comprising:

a receiver for receiving a print command and image data from an external apparatus;

a recording controller for controlling said image recording apparatus to record the image on the sheet in accordance with the print command and image data received by said receiver;

an input terminal for inputting a signal indicating a state of sheet transportation in said image recording apparatus from said image recording apparatus, said image recording apparatus including a second microcomputer; and an output terminal for outputting a notice command for starting an operation of said sheet stacking apparatus to said sheet stacking apparatus, said sheet stacking apparatus including a third microcomputer, in accordance with the signal input by said input terminal.

* * * * *

UNITED STATES PATENT AND TRADEMARK OFFICE

CERTIFICATE OF CORRECTION

PATENT NO. : 6,540,418 B1
DATED : April 1, 2003
INVENTOR(S) : Kaoru Sato

It is certified that error appears in the above-identified patent and that said Letters Patent is hereby corrected as shown below:

Title page,
Item [56], References Cited, FOREIGN PATENT DOCUMENTS, “11035226” should read -- 11-035226 --.

Column 1,
Line 10, “as” should read -- as a --; and
Line 57, “the” should be deleted.

Column 2,
Line 59, “Numeral” should read -- Reference numeral --.

Column 3,
Line 51, “Copera-” should read -- opera- --.

Column 5,
Line 66, “period” (both occurrences) should read -- period of --.

Signed and Sealed this

Fourteenth Day of October, 2003

JAMES E. ROGAN
*Director of the United States Patent and Trademark Office*